US012428806B2

(12) United States Patent
Kadono

(10) Patent No.: US 12,428,806 B2
(45) Date of Patent: Sep. 30, 2025

(54) SYSTEM AND METHOD FOR CONTROLLING WORK MACHINE

(71) Applicant: KOMATSU LTD., Tokyo (JP)

(72) Inventor: Yuuichi Kadono, Tokyo (JP)

(73) Assignee: KOMATSU LTD., Tokyo (JP)

( * ) Notice: Subject to any disclaimer, the term of this patent is extended or adjusted under 35 U.S.C. 154(b) by 519 days.

(21) Appl. No.: 17/922,631

(22) PCT Filed: Jun. 9, 2021

(86) PCT No.: PCT/JP2021/021869
§ 371 (c)(1),
(2) Date: Nov. 1, 2022

(87) PCT Pub. No.: WO2022/018993
PCT Pub. Date: Jan. 27, 2022

(65) Prior Publication Data

US 2023/0220650 A1 Jul. 13, 2023

(30) Foreign Application Priority Data

Jul. 20, 2020 (JP) ..... 2020-123405

(51) Int. Cl.
*E02F 3/84* (2006.01)
*E02F 9/22* (2006.01)

(52) U.S. Cl.
CPC ..... *E02F 3/841* (2013.01); *E02F 9/225* (2013.01)

(58) Field of Classification Search
CPC ..... E02F 3/841; E02F 9/225
See application file for complete search history.

(56) References Cited

U.S. PATENT DOCUMENTS 8,639,393 B2 * 1/2014 Taylor ..... E02F 9/2045 701/25
9,228,315 B2 * 1/2016 Edara ..... E02F 9/2045
2013/0041561 A1 2/2013 Asami et al.
2014/0174770 A1 * 6/2014 Wei ..... E02F 3/841 701/27

(Continued)

FOREIGN PATENT DOCUMENTS

JP 2011-236759 A 11/2011
JP 2016-172963 A 9/2016
JP 2018-21345 A 2/2018

OTHER PUBLICATIONS

The International Search Report for the corresponding international application No. PCT/JP2021/021869, issued on Aug. 24, 2021.

*Primary Examiner* — Matthew R Buck
(74) *Attorney, Agent, or Firm* — GLOBAL IP COUNSELORS, LLP

(57) ABSTRACT

A controller acquires current position data indicative of a current position of a work machine. The controller acquires an inclination angle of an actual topography to be dug. The controller acquires a maximum climbing angle when the work machine travels in reverse. The controller determines a digging angle with respect to the actual topography based on the inclination angle and the maximum climbing angle. The controller determines a target digging trajectory based on the digging angle. The controller controls a work implement according to the target digging trajectory.

13 Claims, 8 Drawing Sheets

(56) References Cited

U.S. PATENT DOCUMENTS

| | | | | |
|---|---|---|---|---|
| 2016/0076223 | A1* | 3/2016 | Wei | G05D 1/021 701/50 |
| 2016/0153175 | A1* | 6/2016 | Wei | E02F 9/262 701/50 |
| 2016/0258129 | A1* | 9/2016 | Wei | E02F 3/841 |
| 2017/0153717 | A1* | 6/2017 | Moore | G06F 3/0619 |
| 2018/0038068 | A1 | 2/2018 | Hashimoto et al. | |

* cited by examiner

SYSTEM AND METHOD FOR CONTROLLING WORK MACHINE

CROSS-REFERENCE TO RELATED APPLICATIONS

This application is a U.S. National stage application of International Application No. PCT/JP2021/021869, filed on Jun. 9, 2021. This U.S. National stage application claims priority under 35 U.S.C. § 119(a) to Japanese Patent Application No. 2020-123405, filed in Japan on Jul. 20, 2020, the entire contents of which are hereby incorporated herein by reference.

TECHNICAL FIELD

The present invention relates to a system and a method for controlling a work machine including a work implement.

BACKGROUND INFORMATION

A technique for automatically controlling a position of a work implement has been conventionally proposed in work machines, such as bulldozers or graders. For example, in Japanese Unexamined Patent Publication No. 2018-21345, a controller of the work machine acquires an inclination angle of an actual topography. The controller determines a virtual design surface that is inclined at an inclination angle smaller than the inclination angle of the actual topography. The controller controls a work implement so that the work implement moves along the inclined virtual design surface.

SUMMARY

The work machine digs an actual topography while traveling forward, then returns on the dug topography while traveling in reverse. In such operations, if the virtual design surface is inclined downward from a current position of the work machine, the topography after digging will be a slope inclined downward. In that case, if the inclination angle of the slope is too steep, the work machine cannot climb the slope while traveling in reverse. This makes it difficult for the work machine to move after digging of the actual topography. An object of the present disclosure is to facilitate the work machine to move after digging of the actual topography.

A system according to a first aspect of the present disclosure is a system for controlling a work machine including a work implement. The system includes a sensor and a controller. The sensor detects a current position of the work machine. The controller communicates with the sensor. The controller is configured to execute the following processes. The controller acquires current position data indicative of the current position of the work machine. The controller acquires an inclination angle of an actual topography to be dug. The controller acquires a maximum climbing angle when the work machine travels in reverse. The controller determines a digging angle with respect to the actual topography based on the inclination angle and the maximum climbing angle. The controller determines a target digging trajectory based on the digging angle. The controller controls the work implement according to the target digging trajectory.

A method according to a second aspect of the present disclosure is a method for controlling a work machine including a work implement. The method includes the following processes. A first process is to acquire current position data indicative of a current position of the work machine. A second process is to acquire an inclination angle of an actual topography to be dug. A third process is to acquire a maximum climbing angle of the work machine. A fourth process is to determine a digging angle with respect to the actual topography based on the inclination angle and the maximum climbing angle. A fifth process is to determine a target digging trajectory based on the digging angle. A sixth process is to control the work implement according to the target digging trajectory.

A work machine according to a third aspect of the present disclosure includes a work implement, a position sensor, and a controller. The position sensor detects a current position of the work machine. The controller communicates with the position sensor. The controller is configured to execute the following processes. The controller acquires current position data indicative of the current position of the work machine. The controller acquires an inclination angle of an actual topography to be dug. The controller acquires a maximum climbing angle when the work machine travels in reverse. The controller determines a digging angle with respect to the actual topography based on the inclination angle and the maximum climbing angle. The controller determines a target digging trajectory based on the digging angle. The controller controls the work implement according to the target digging trajectory.

According to the present disclosure, the digging angle of the target digging trajectory is determined based on the maximum climbing angle of the work machine and the inclination angle of the actual topography. This prevents the work machine from being unable to climb the slope of the actual topography after digging. Accordingly, it is possible to facilitate the work machine to move after digging of the actual topography.

DESCRIPTION OF EMBODIMENTS

Figure 1:
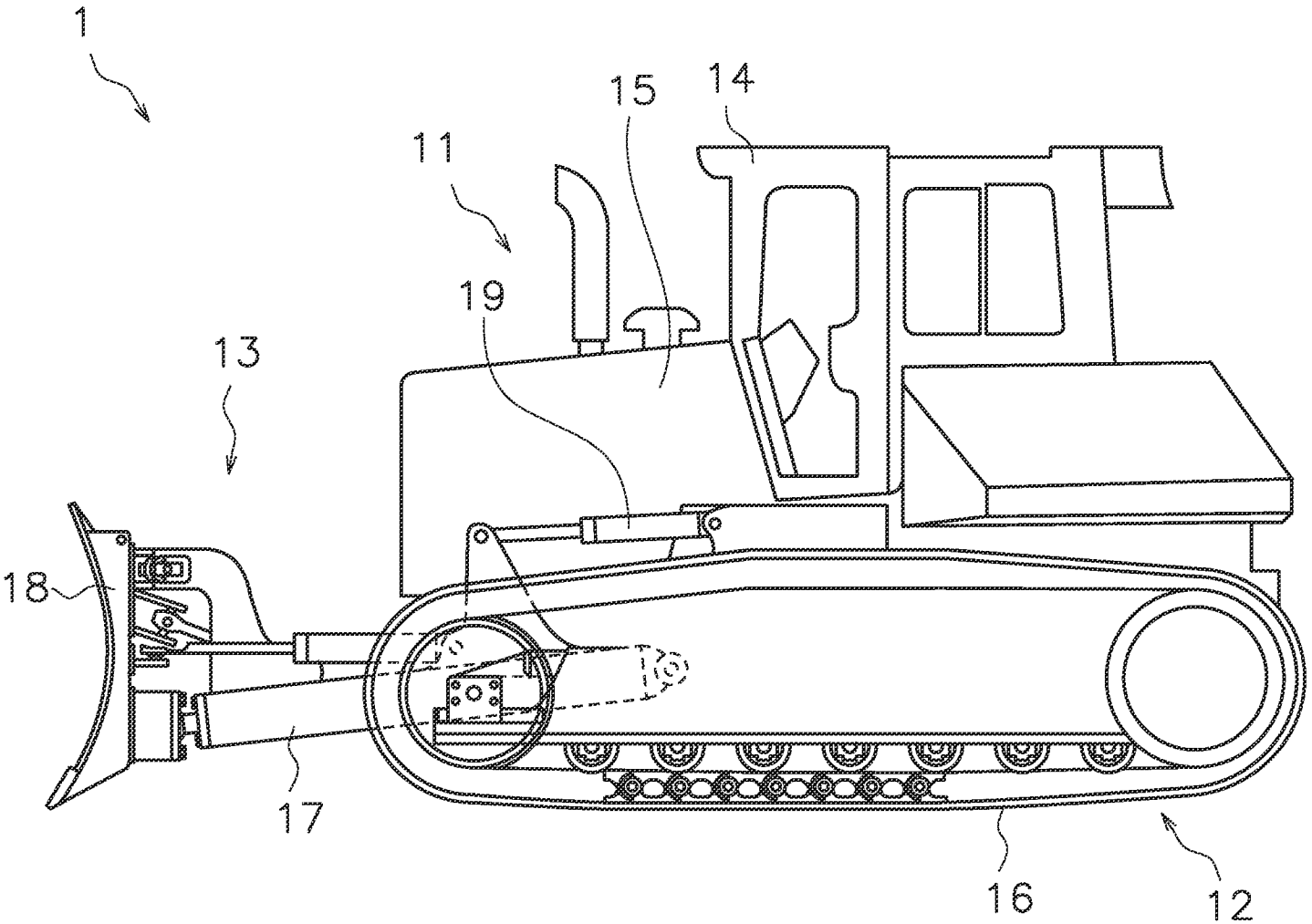
FIG. 1 is a side view of a work machine according to an embodiment.

Hereinafter, a control system and a control method of a work machine 1 according to an embodiment will be described with reference to the drawings. FIG. 1 is a side view of the work machine 1 according to the embodiment. The work machine 1 according to the present embodiment is a bulldozer. The work machine 1 includes a vehicle body 11, a travel device 12, and a work implement 13.

The vehicle body 11 includes an operating cabin 14 and an engine compartment 15. An operator's seat that is not illustrated is disposed in the operating cabin 14. The engine compartment 15 is disposed in front of the operating cabin 14. The travel device 12 is attached to a lower portion of the vehicle body 11. The travel device 12 includes a pair of left and right crawler belts 16. Only the left crawler belt 16 is illustrated in FIG. 1. The work machine 1 travels due to the rotation of the crawler belts 16.

The work implement 13 is attached to the vehicle body 11. The work implement 13 includes a lift frame 17, a blade 18, and a lift cylinder 19. The lift frame 17 is attached to the vehicle body 11 so as to be movable up and down. The lift frame 17 supports the blade 18.

The blade 18 is disposed in front of the vehicle body 11. The blade 18 moves up and down accompanying the up and down movements of the lift frame 17. The lift cylinder 19 is coupled to the vehicle body 11 and the lift frame 17. Due to the extension and contraction of the lift cylinder 19, the lift frame 17 moves up and down.

Figure 2:
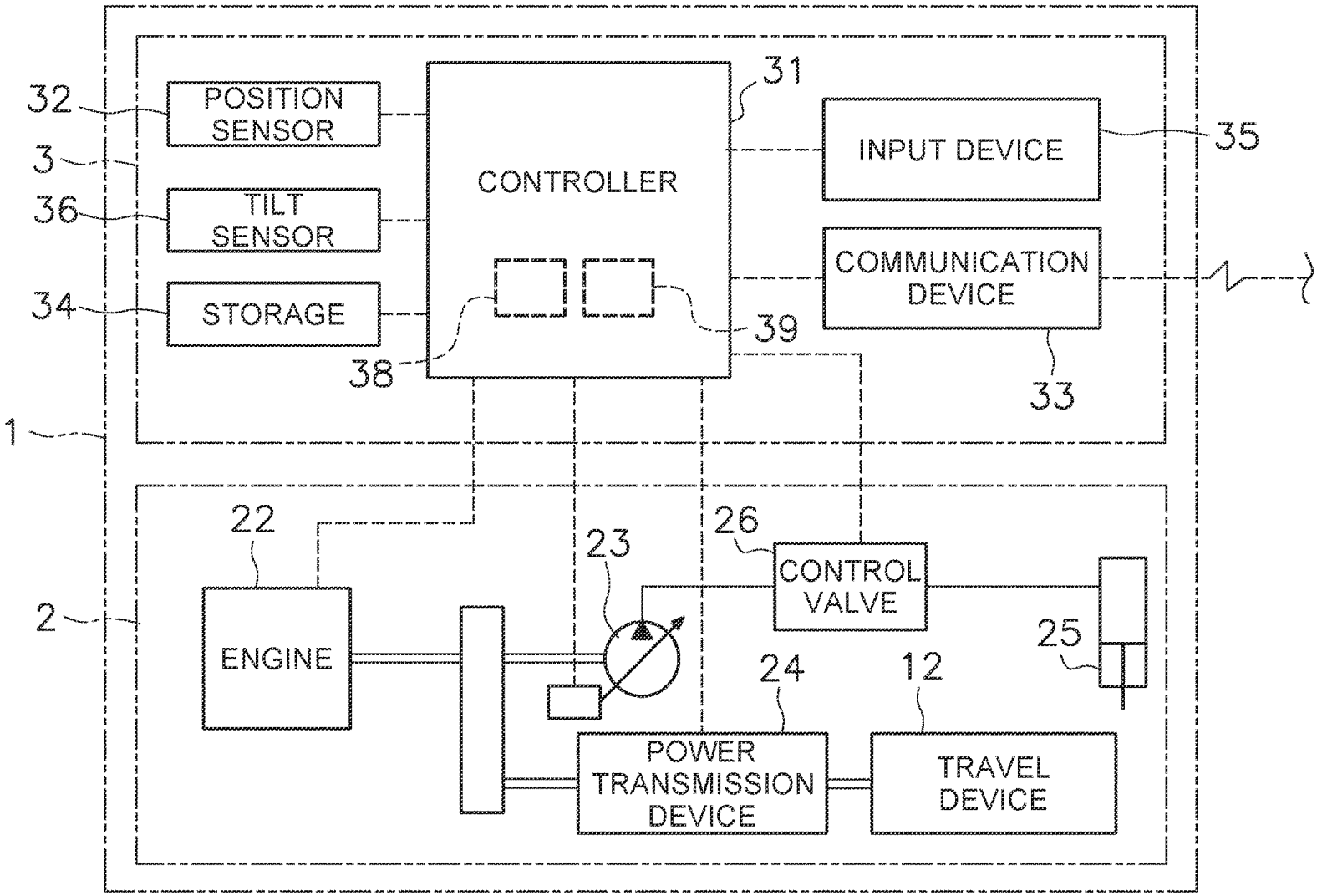
FIG. 2 is a block diagram illustrating a configuration of a drive system and a control system of the work machine.

FIG. 2 is a block diagram illustrating a configuration of a drive system 2 and a control system 3 of the work machine 1. As illustrated in FIG. 2, the drive system 2 includes an engine 22, a hydraulic pump 23, and a power transmission device 24.

The hydraulic pump 23 is driven by the engine 22 to discharge hydraulic fluid. The hydraulic fluid discharged from the hydraulic pump 23 is supplied to a hydraulic actuator 25. The hydraulic actuator 25 includes the lift cylinder 19 described above. Although one hydraulic pump 23 is illustrated in FIG. 2, a plurality of hydraulic pumps may be provided.

A control valve 26 is disposed between the hydraulic actuator 25 and the hydraulic pump 23. The control valve 26 is a proportional control valve and controls the flow rate of hydraulic fluid supplied from the hydraulic pump 23 to the lift cylinder 19. The control valve 26 may be a pressure proportional control valve. Alternatively, the control valve 26 may be an electromagnetic proportional control valve.

The power transmission device 24 transmits driving force of the engine 22 to the travel device 12. The power transmission device 24 may be, for example, a transmission having a torque converter or a plurality of transmission gears. Alternatively, the power transmission device 24 may be another type of power transmission device, such as a hydro static transmission (HST).

The control system 3 includes a controller 31, a position sensor 32, a communication device 33, a storage 34, an input device 35, and a tilt sensor 36. The controller 31 is programmed to control the work machine 1 based on acquired data. The controller 31 includes a memory 38 and a processor 39. The memory 38 includes, for example, a random access memory (RAM) and a read only memory (ROM). The storage 34 includes, for example, a semiconductor memory, a hard disk, or the like. The memory 38 and the storage 34 record computer commands and data for controlling the work machine 1.

The processor 39 is, for example, a CPU, but may be another type of processor. The processor 39 executes processes for controlling the work machine 1 based on the computer commands and data stored in the memory 38 or the storage 34. The communication device 33 is, for example, a module for wireless communication and communicates with a device outside of the work machine 1. The communication device 33 may be a device that uses a mobile communication network. Alternatively, the communication device 33 may be a device that uses a local area network (LAN) or another network, such as the Internet.

The position sensor 32 detects a position of the work machine 1. The position sensor 32 includes, for example, a global navigation satellite system (GNSS) receiver such as a global positioning system (GPS). The position sensor 32 is mounted on the vehicle body 11. Alternatively, the position sensor 32 may be mounted on another position such as on the work implement 13. The controller 31 acquires current position data indicative a current position of the work machine 1 from the position sensor 32.

The tilt sensor 36 detects a tilt of the work machine 1. The tilt sensor 36 is, for example, an inertial measurement unit (IMU). The tilt of the work machine 1 indicates the tilt of the vehicle body 11. The tilt of the work machine 1 includes a roll angle and a pitch angle of the vehicle body 11. The roll angle is an angle in the left-right direction of the vehicle body 11 with respect to the horizontal direction. The pitch angle is an angle in the front-back direction of the vehicle body 11 with respect to the horizontal direction. The tilt sensor 36 outputs machine tilt data indicative of the tilt of the work machine 1. The controller 31 acquires the machine tilt data from the tilt sensor 36.

The input device 35 is operable by an operator. The input device 35 may include, for example, a touch screen. The input device 35 receives an operation by the operator and outputs a signal indicative of the operation by the operator to the controller 31.

The controller 31 outputs command signals to the engine 22, the hydraulic pump 23, the power transmission device 24, and the control valve 26, thereby controlling said devices. For example, the controller 31 controls the displacement of the hydraulic pump 23 and the opening degree of the control valve 26, thereby operating the hydraulic actuator 25. As a result, the work implement 13 can be operated.

The controller 31 controls the rotation speed of the engine 22 and the power transmission device 24, thereby causing the work machine 1 to travel. For example, when the power transmission device 24 is an HST, the controller 31 controls the displacement of the hydraulic pump of the HST and the displacement of the hydraulic motor. When the power transmission device 24 is a transmission having a plurality of transmission gears, the controller 31 controls an actuator for gear shifting. Further, the controller 31 controls the power transmission device 24 so as to bring about a speed difference between the left and right crawler belts 16, thereby causing the work machine 1 to rotate.

Next, automatic control of the work machine 1 executed by the controller 31 will be described. The controller 31 controls the engine 22 and the power transmission device 24, thereby causing the work machine 1 to travel automatically. Further, the controller 31 controls the engine 22, the hydraulic pump 23, and the control valve 26, thereby automatically controlling the work implement 13.

Figure 3:
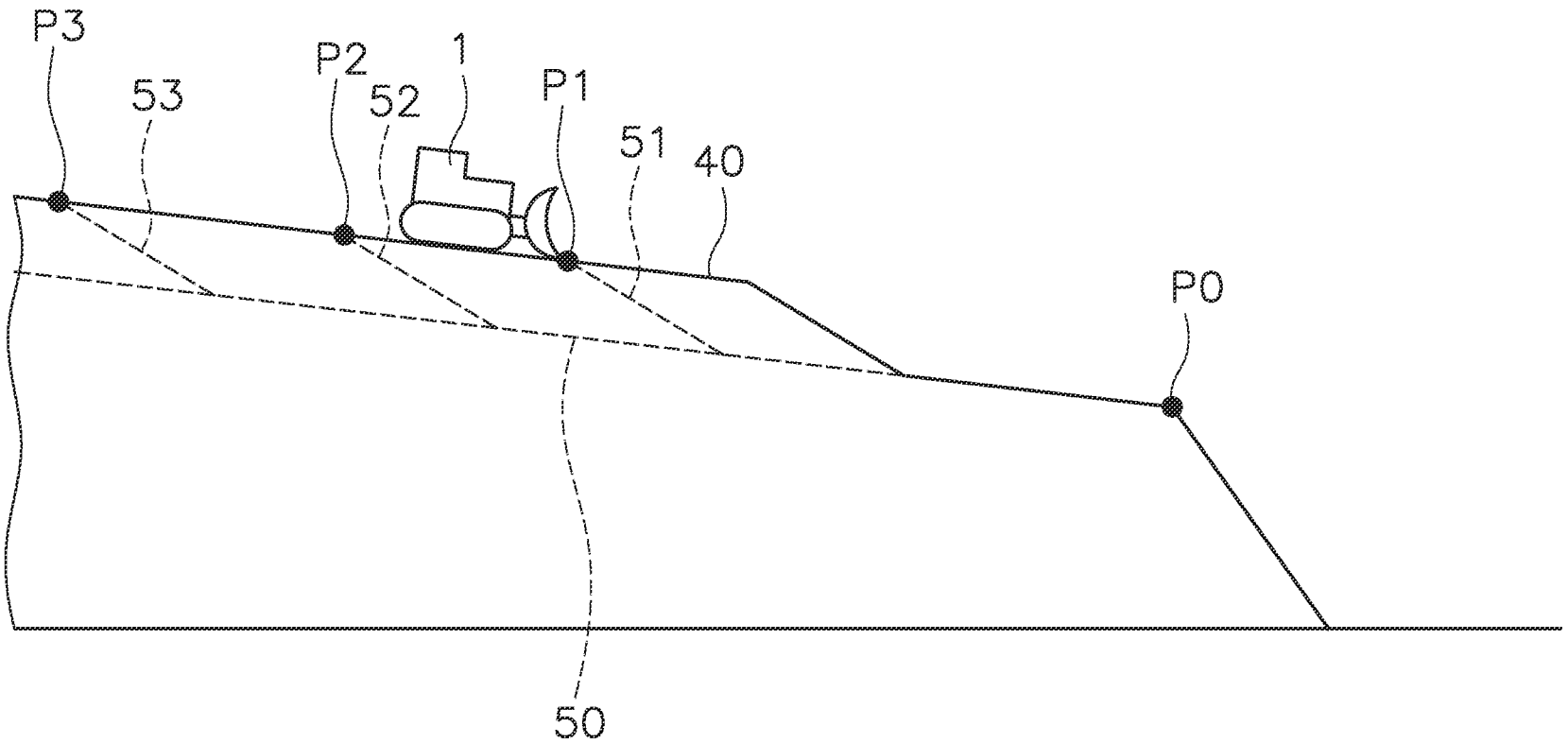
FIG. 3 is a side view of an actual topography at a work site.

Hereinafter, automatic control of digging work performed by the work machine 1 at a work site will be described. FIG. 3 is a side view of an actual topography 40 at the work site. In the present embodiment, the work machine performs slot dosing under automatic control. The slot dosing involves work in which the work machine 1 repeatedly travels back and forth on the same slot to perform digging. FIG. 3 is a side view of the actual topography 40 in a slot. As illustrated in FIG. 3, the work machine 1 digs the actual topography 40 so that the actual topography 40 has a shape along a target design surface 50.

The work machine 1 determines target digging trajectories 51 to 53. The target digging trajectories 51 to 53 are target trajectories of the work implement 13 toward the target design surface 50 from respective digging start positions P1 to P3. In the example illustrated in FIG. 3, the target digging trajectories 51 to 53 include first to third target digging trajectories 51 to 53. The start positions P1 to P3 include first to third start positions P1 to P3. The first to third start positions P1 to P3 are aligned at an interval on the actual topography 40. The first to third start positions P1 to P3 are disposed along a direction in which the slot extends. The first target digging trajectory 51 is inclined downward from the first start position P1. The second target digging trajectory 52 is inclined downward from the second start position P2. The third target digging trajectory 53 is inclined downward from the third start position P3.

For example, the controller 31 may determine points aligned at a predetermined interval on the actual topography 40 as the start positions P1 to P3. The controller 31 may determine the start positions P1 to P3 according to a parameter such as an expected amount of soil to be dug or the machine capacity of the work machine 1. The controller 31 may acquire the start positions P1 to P3 that are set in advance from an external computer. In the example illustrated in FIG. 3, the number of the start positions is three. However, the number of the start positions is not limited to three. The number of the start positions may be less than three or greater than three.

The controller 31 controls the work machine 1 to travel forward from the first start position P1 to a switching position P0. While causing the work machine 1 to travel forward, the controller causes the work implement 13 to move according to the first target digging trajectory 51 and the target design surface 50. As a result, the actual topography 40 is dug according to the first target digging trajectory 51 and the target design surface 50, and the dug soil is transported to the switching position P0. Upon the work machine 1 reaching the switching position P0, the controller 31 controls the work machine 1 to travel in reverse to a next start position (the second start position P2).

Next, the controller 31 controls the work machine 1 to travel forward from the second start position P2 to the switching position P0. While causing the work machine 1 to travel forward, the controller causes the work implement 13 to move according to the second target digging trajectory 52 and the target design surface 50. As a result, the actual topography 40 is dug according to the second target digging trajectory 52 and the target design surface 50, and the dug soil is transported to the switching position P0. Upon the work machine 1 reaching the switching position P0, the controller 31 controls the work machine 1 to travel in reverse to a next start position (the third start position P3). Then, the work machine 1 repeats the above work, whereby the actual topography 40 is dug so as to have a shape along the target design surface 50.

Figure 4:
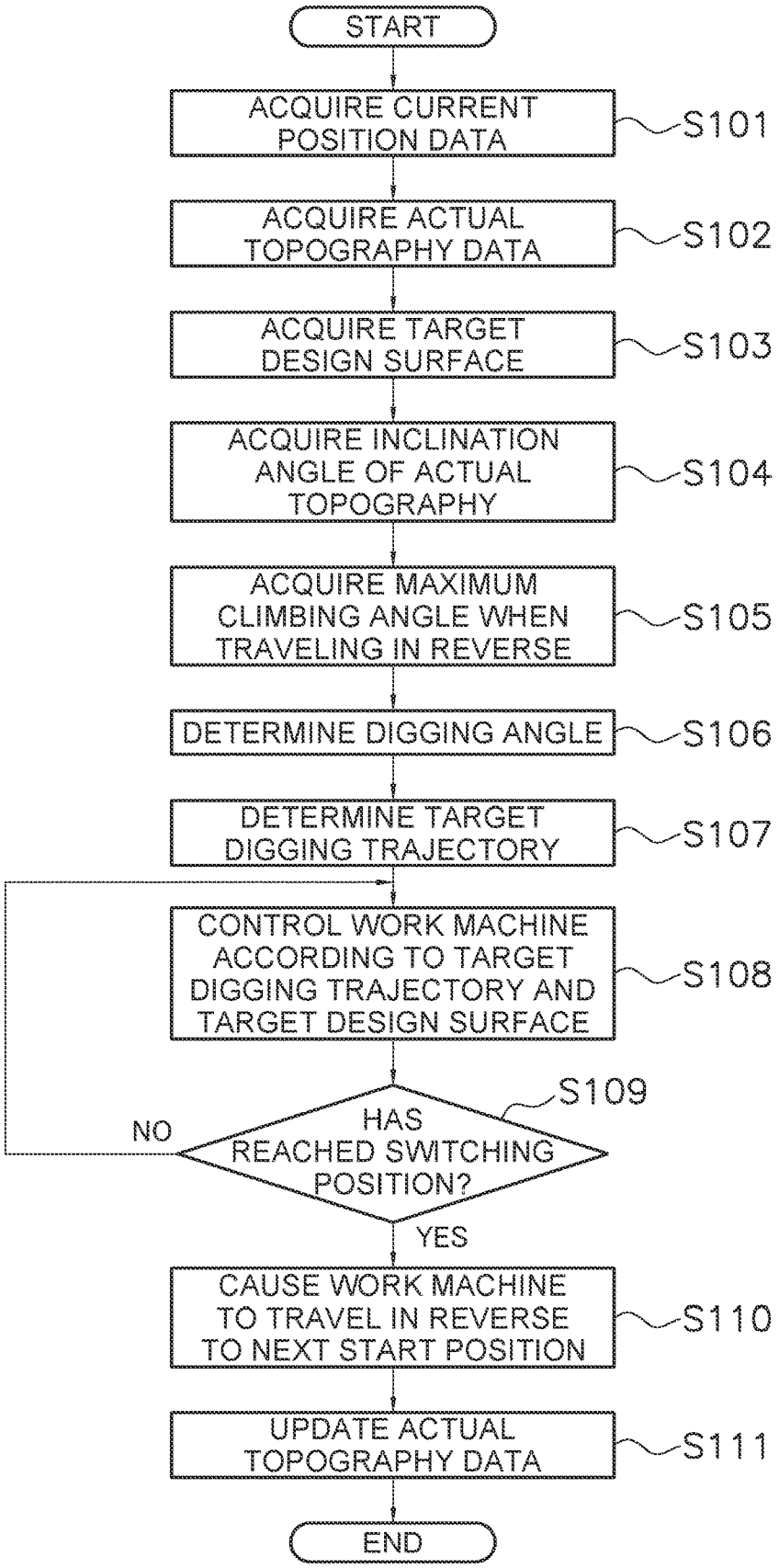
FIG. 4 is a flowchart illustrating processes of automatic control of the work machine.

FIG. 4 is a flowchart illustrating processes of the automatic control of the work machine 1. As illustrated in FIG. 4, in step S101, the controller 31 acquires current position data. The controller 31 acquires the current position data from the position sensor 32. In step S102, the controller 31 acquires actual topography data. The actual topography data is data indicative of the actual topography 40. For example, the actual topography data includes the plane coordinates and heights of a surface of the actual topography 40.

In step S103, the controller 31 acquires the target design surface 50. At least a portion of the target design surface 50 is positioned below the actual topography 40. For example, the controller 31 may determine the target design surface 50 by displacing the actual topography 40 downward by a predetermined distance. The controller 31 may determine the target design surface 50 according to a parameter, such as the expected amount of soil to be dug or the machine capacity of the work machine 1. The operator may manually set the target design surface 50 using the input device 35. The controller 31 may acquire the target design surface 50 that is set in advance from an external computer.

Figure 5:
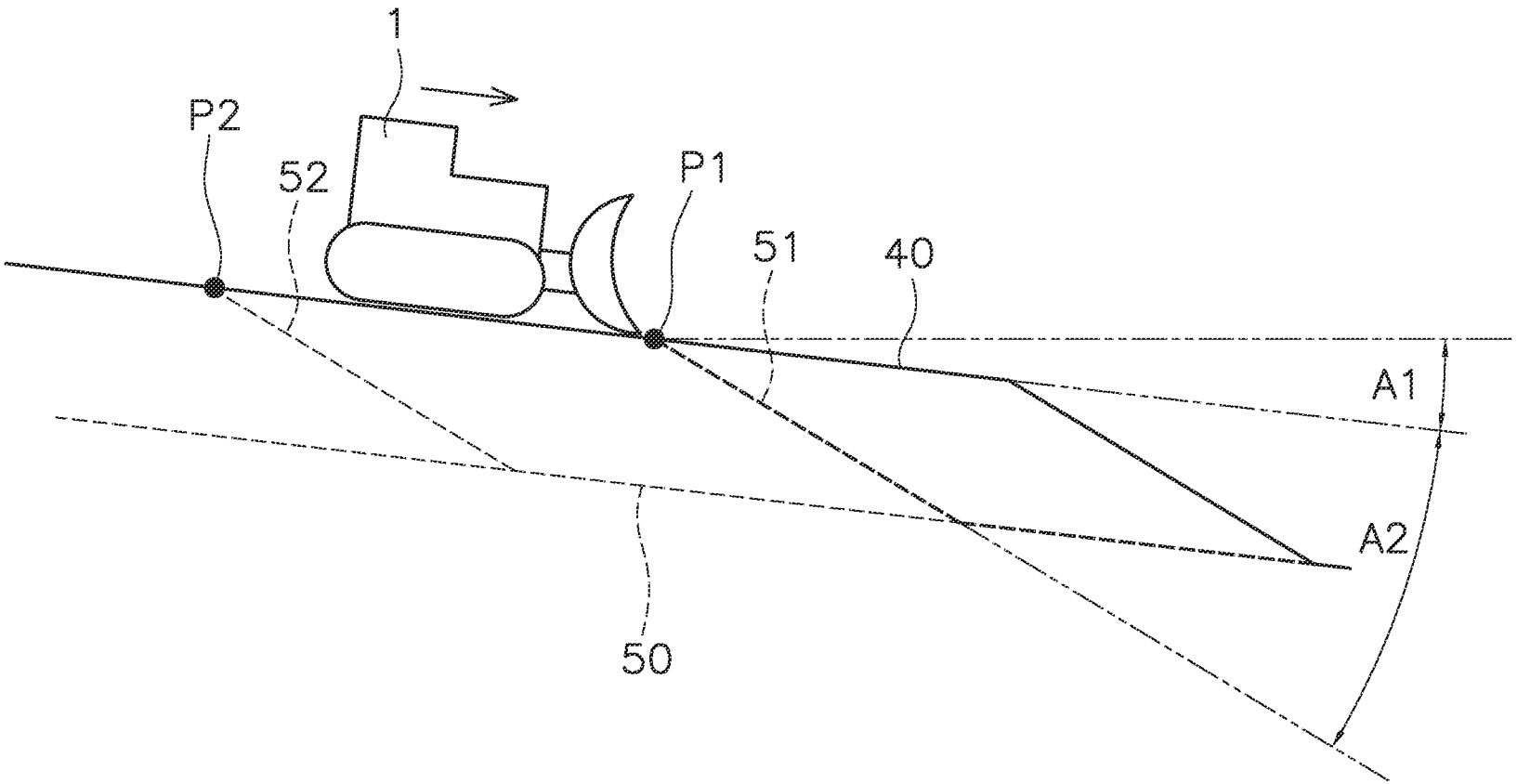
FIG. 5 is a view illustrating an example of a target design surface and a target digging trajectory.

In step S104, the controller 31 acquires an inclination angle A1 of the actual topography 40. The controller 31 calculates the inclination angle A1 from the actual topography data. The controller 31 calculates the inclination angle A1 of the actual topography 40 at the start position P1 of digging work. As illustrated in FIG. 5, the inclination angle A1 of the actual topography 40 is an angle of the actual topography 40 in the tangential direction with respect to the horizontal direction at the start position P1.

In step S105, the controller 31 acquires a maximum climbing angle when the work machine 1 travels in reverse. For example, the maximum climbing angle when the work machine 1 travels in reverse is stored in the memory 38 or the storage 34. Alternatively, the controller 31 may acquire the maximum climbing angle when the work machine 1 travels in reverse from an external computer.

In step S106, the controller 31 determines a digging angle A2. As illustrated in FIG. 5, the digging angle A2 is an angle of the target digging trajectory 51 with respect to the inclination direction of the actual topography 40. The controller 31 determines the digging angle A2 so that the sum of the inclination angle A1 and the digging angle A2 is equal to or less than the maximum climbing angle. For example, the controller 31 determines the digging angle A2 so that the sum of the inclination angle A1 and the digging angle A2 is equal to the maximum climbing angle. Alternatively, the controller 31 may determine the digging angle A2 so that the sum of the inclination angle A1 and the digging angle A2 is equal to a value acquired by multiplying the maximum climbing angle by a predetermined ratio less than one. Alternatively, the controller 31 may determine the digging angle A2 so that the sum of the inclination angle A1 and the digging angle A2 is less than the maximum climbing angle by a predetermined angle.

In step S107, the controller 31 determines the target digging trajectory 51. The controller 31 determines the target digging trajectory 51 based on the digging angle A2. The controller 31 determines a trajectory extending from the start position P1 at the digging angle A2 with respect to the actual topography 40 as the target digging trajectory 51.

In step S108, the controller 31 controls the work implement 13 according to the target digging trajectory 51 and the target design surface 50. The controller 31 causes a tip of the blade of the work implement 13 to move according to the target digging trajectory 51, while causing the work machine 1 to travel forward. Further, the controller 31 causes the tip of the blade of the work implement 13 to move according to the target design surface 50, while causing the work machine 1 to travel forward.

In step S109, the controller 31 determines whether the work machine 1 has reached the switching position P0. The controller 31 may determine the switching position P0 from the actual topography data. The operator may manually set the switching position P0 using the input device 35. The controller 31 may acquire the switching position P0 that is set in advance from an external computer. The controller 31 continues the process of step S108 until the work machine 1 reaches the switching position P0. However, when a specific condition is satisfied, such as when the load on the work machine 1 becomes excessively large, the controller 31 may raise the work implement 13.

Figure 6:
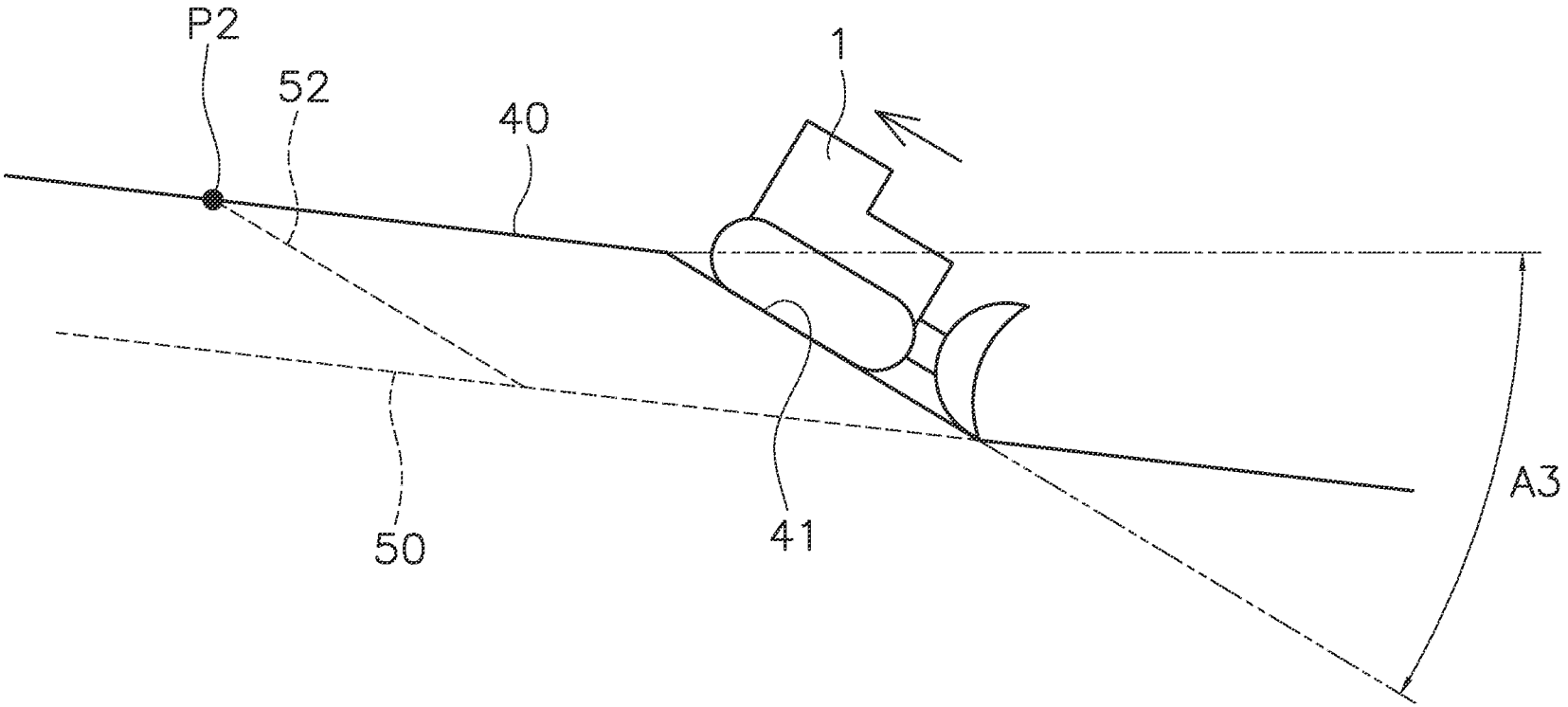
FIG. 6 is a view illustrating an example of a topography after digging.

Upon the work machine 1 reaching the switching position P0, the process proceeds to step S110. In step S110, the controller 31 causes the work machine 1 to travel in reverse to the next start position P2. At this time, as illustrated in FIG. 6, the work machine 1 climbs a slope 41 of the actual topography 40 formed by digging while traveling in reverse.

In step S111, the controller 31 updates the actual topography data. For example, the controller 31 acquires the latest trajectory of the tip of the blade of the work implement 13 from the current position data. The controller 31 updates the actual topography data using the latest trajectory of the tip of the blade of the work implement 13 as the latest actual topography 40. Alternatively, the controller 31 may update the actual topography data using the trajectory of the bottom surface of the crawler belts 16 as the latest actual topography 40. Alternatively, the controller 31 may update the actual topography data using survey data measured by a survey device outside of the work machine 1. The actual topography data may be updated as needed. Alternatively, the actual topography data may be updated at a predetermined timing.

The other target digging trajectories 52 and 53 are determined in the same manner as in the above processes. Then, the above processes are repeated, whereby the actual topography 40 is dug so that the actual topography 40 approaches the target design surface 50.

In the control system 3 and the control method of the work machine 1 according to the present embodiment described above, the digging angle A2 of the target digging trajectories 51 to 53 is determined based on the maximum climbing angle of the work machine 1 and the inclination angle A1 of the actual topography 40. Therefore, as illustrated in FIG. 6, the inclination angle A3 of the slope 41 of the actual topography 40 formed after digging with respect to the horizontal direction is equal to or less than the maximum climbing angle when the work machine 1 travels in reverse. This prevents the work machine 1 from being unable to climb the slope of the actual topography after digging. Although an embodiment of the present invention has been described so far, the present invention is not limited to the above embodiment and various modifications can be made without departing from the gist of the invention. The work machine 1 is not limited to a bulldozer and may be another machine, such as a wheel loader. The travel device 12 may include tires instead of the crawler belts. The controller 31 may have a plurality of controllers that are separate from each other. The above-mentioned processes may be distributed and executed among the plurality of controllers.

Figure 7:
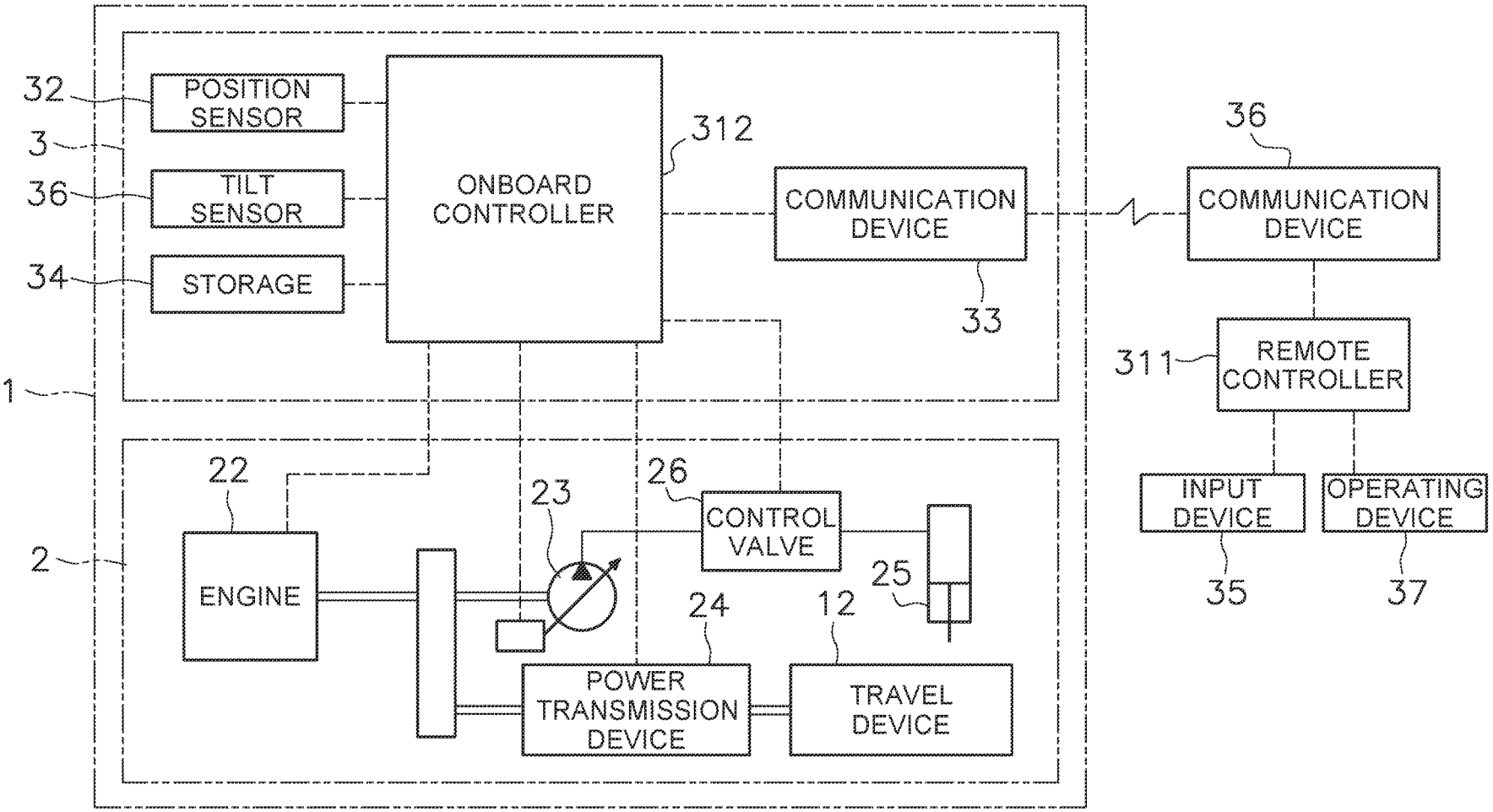
FIG. 7 is a block diagram illustrating a configuration of the drive system and the control system of the work machine according to another embodiment.

The work machine 1 may be a vehicle that can be remotely operable. In that case, the operating cabin may be omitted from the work machine 1. A portion of the control system 3 may be disposed outside of the work machine 1. As illustrated in FIG. 7, the controller 31 may include a remote controller 311 disposed outside of the work machine 1 and an onboard controller 312 mounted on the work machine 1. The remote controller 311 and the onboard controller 312 may be able to communicate wirelessly via the communication devices 33 and 36. A portion of the afore-mentioned functions of the controller 31 may be executed by the remote controller 311 and the remaining functions may be executed by the onboard controller 312. For example, the processes for determining the target digging trajectories 51 to 53 may be executed by the remote controller 311 and the processes for causing the work machine 1 to operate may be executed by the onboard controller 312.

The automatic control of the work machine 1 may be a semi-automatic control performed in combination with manual operations by an operator. Alternatively, the automatic control may be a fully automatic control that is performed without manual operations by an operator. For example, as illustrated in FIG. 7, the work machine 1 may be remotely operated by an operator operating the operating device 37 disposed outside of the work machine 1. Alternatively, the operating device 37 may be mounted on the work machine 1.

The processes of the automatic control of the work machine 1 are not limited to the processes described above and may be changed. For example, some of the above processes may be changed or omitted. A process that is different from the above processes may be added to the processes of the automatic control.

For example, the controller 31 may acquire the inclination angle A1 of the actual topography 40 based on the machine tilt data detected by the tilt sensor 36. The controller 31 may calculate the inclination angle A1 of the actual topography 40 from the pitch angle of the work machine 1.

Figure 8:
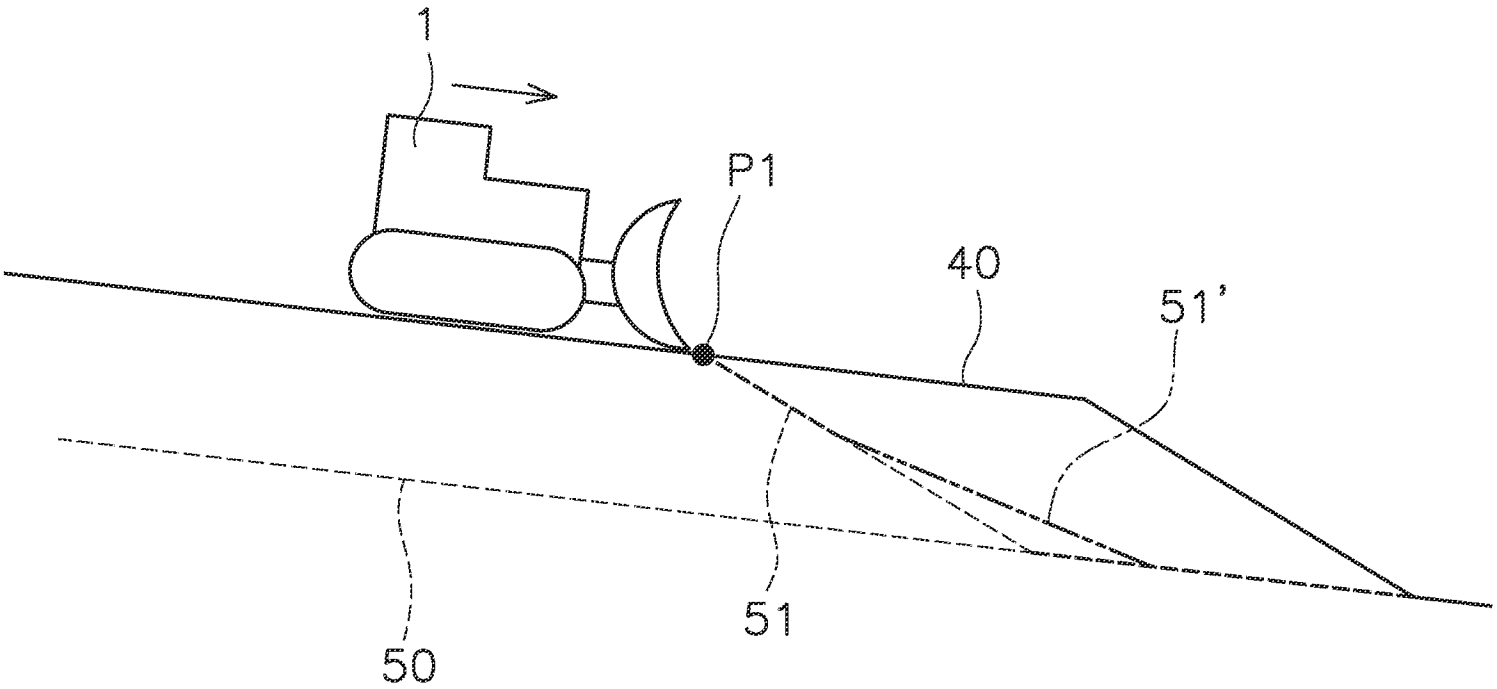
FIG. 8 is a view illustrating an example of the target design surface and the target digging trajectory according to a modified example.

The controller 31 may monitor the tilt of the work machine 1 during digging of the actual topography 40. The controller 31 may raise the work implement 13 above the target digging trajectory 51 before the tilt of the work machine 1 exceeds the maximum climbing angle. Alternatively, the controller 31 may modify the target digging trajectory 51 so that the tilt of the work machine 1 does not exceed the maximum climbing angle. For example, as illustrated in FIG. 8, the controller 31 causes the work implement 13 to move from the start position P1 according to the initial target digging trajectory 51. During digging, the controller 31 monitors the tilt of the work machine 1 and determines whether the tilt of the work machine 1 has reached a predetermined upper limit value.

The predetermined upper limit value is equal to or less than the maximum climbing angle. When the tilt of the work machine 1 has reached the predetermined upper limit value, the controller 31 raises the work implement 13 above the initial target digging trajectory 51. Alternatively, when the tilt of the work machine 1 has reached the predetermined upper limit value, the controller 31 modifies the target digging trajectory 51 so that the digging angle A2 decreases. In FIG. 8, a trajectory 51' indicates a trajectory of the tip of the blade of the work implement 13 when the work implement 13 is raised during digging or the target digging trajectory 51 after the modification.

The controller 31 may raise the work implement 13 or modify the target digging trajectory 51 when the tilt of the work machine 1 has increased and reached the maximum climbing angle. Alternatively, the controller 31 may raise the work implement 13 or modify the target digging trajectory 51 when the tilt of the work machine 1 is equal to a value acquired by multiplying the maximum climbing angle by a predetermined ratio less than one. Alternatively, the controller 31 may raise the work implement 13 or modify the target digging trajectory 51 when the tilt of the work machine 1 is equal to a value less than the maximum climbing angle by a predetermined angle.

The controller 31 may determine the target digging trajectory 51 using the above-mentioned digging angle as an upper limit. For example, the controller 31 determines an initial value of a target angle of the target digging trajectory 51 with respect to the actual topography 40 based on a parameter such as the amount of soil to be dug or the machine capacity of the work machine 1. When the initial value of the target angle is equal to or less than the digging angle, the controller 31 determines the initial value as the target angle. The controller 31 determines a trajectory extending from the start position at the target angle as the target digging trajectory 51. When the initial value of the target angle is greater than the digging angle, the controller 31 determines the digging angle as the target angle. In this case, in the same manner as in the above embodiment, the controller 31 determines a trajectory extending from the start position at the digging angle as the target digging trajectory 51.

According to the present disclosure, it is possible to facilitate the work machine to move after digging of the actual topography.

The invention claimed is:

1. A system for controlling a work machine including a work implement, the system comprising:

a position sensor configured to detect a current position of the work machine; and a controller configured to communicate with the position sensor, the controller being further configured to acquire current position data indicative of the current position of the work machine, acquire an inclination angle of an actual topography to be dug, the inclination angle being an angle of the actual topography in a tangential direction with respect to a horizontal direction, acquire a maximum climbing angle when the work machine travels in reverse, the maximum climbing angle being a maximum angle at which the work machine is capable of climbing a slope of the actual topography with respect to the horizontal direction after digging, determine a digging angle with respect to the actual topography based on the inclination angle and the maximum climbing angle, determine a target digging trajectory based on the digging angle, and control the work implement according to the target digging trajectory.

2. The system according to claim 1, wherein the controller is further configured to determine the digging angle so that a sum of the inclination angle and the digging angle is equal to or less than the maximum climbing angle.

3. The system according to claim 1, wherein the controller is further configured to acquire actual topography data indicative of the actual topography, and acquire the inclination angle from the actual topography data.

4. The system according to claim 1, further comprising a tilt sensor configured to detect a tilt of the work machine, the controller being further configured to acquire the tilt of the work machine, and acquire the inclination angle of the actual topography based on the tilt of the work machine.

5. System according to claim 1, further comprising a tilt sensor configured to detect a tilt of the work machine, the controller being further configured to monitor the tilt of the work machine during digging of the actual topography, and cause the work implement to raise before the tilt of the work machine exceeds the maximum climbing angle.

6. The system according to claim 1, further comprising a tilt sensor configured to detect a tilt of the work machine, the controller being further configured to monitor the tilt of the work machine during digging of the actual topography, and modify the target digging trajectory so that the tilt of the work machine does not exceed the maximum climbing angle.

7. A method for controlling a work machine including a work implement, the method comprising:

acquiring current position data indicative of a current position of the work machine;

acquiring an inclination angle of an actual topography to be dug, the inclination angle being an angle of the actual topography in a tangential direction with respect to a horizontal direction;

acquiring a maximum climbing angle when the work machine travels in reverse, the maximum climbing angle being a maximum angle at which the work machine is capable of climbing a slope of the actual topography with respect to the horizontal direction after digging;

determining a digging angle with respect to the actual topography based on the inclination angle and the maximum climbing angle;

determining a target digging trajectory based on the digging angle; and controlling the work implement according to the target digging trajectory.

8. The method according to claim 7, further comprising determining the digging angle so that a sum of the inclination angle and the digging angle is equal to or less than the maximum climbing angle.

9. The method according to claim 7, further comprising acquiring actual topography data indicative of the actual topography; and acquiring the inclination angle from the actual topography data.

10. The method according to claim 7, further comprising acquiring a tilt of the work machine; and acquiring the inclination angle of the actual topography based on the tilt of the work machine.

11. The method according to claim 7, further comprising monitoring a tilt of the work machine during digging of the actual topography; and causing the work implement to raise before the tilt of the work machine exceeds the maximum climbing angle.

12. The method according to claim 7, further comprising monitoring a tilt of the work machine during digging of the actual topography; and modifying the target digging trajectory so that the tilt of the work machine does not exceed the maximum climbing angle.

13. A work machine comprising:

a work implement;

a position sensor configured to detect a current position of the work machine; and a controller configured to communicate with the position sensor, the controller being further configured to acquire current position data indicative of the current position of the work machine, acquire an inclination angle of an actual topography to be dug, the inclination angle being an angle of the actual topography in a tangential direction with respect to a horizontal direction, acquire a maximum climbing angle when the work machine travels in reverse, the maximum climbing angle being a maximum angle at which the work machine is capable of climbing a slope of the actual topography with respect to the horizontal direction after digging, determine a digging angle with respect to the actual topography based on the inclination angle and the maximum climbing angle, determine a target digging trajectory based on the digging angle, and control the work implement according to the target digging trajectory.

* * * * *